United States Patent [19]

Horn

[11] 3,987,734

[45] Oct. 26, 1976

[54] MODULAR RAPID TRANSPORTATION SYSTEM FOR PASSENGERS AND FREIGHT

[76] Inventor: Clifford V. Horn, 457 Lake View, Redwood City, Calif. 94062

[22] Filed: Feb. 5, 1975

[21] Appl. No.: 547,212

[52] U.S. Cl. ..... 104/88; 104/20; 104/25; 104/89; 104/96; 104/153; 105/148

[51] Int. Cl.[2] ..... B61K 1/00

[58] Field of Search ..... 104/18, 20, 25, 88, 104/89, 91, 93, 96, 106, 110, 147 R, 148 R, 149, 153; 105/148, 149, 150; 246/187 B; 198/177 R, 177 T, 16 R, 16 MS, 20 R, 76, 110, 185; 214/38 CB, 42 R

[56] References Cited

UNITED STATES PATENTS

| | | | |
|---|---|---|---|
| 3,101,677 | 8/1973 | Ehinger | 104/91 |
| 3,345,951 | 10/1967 | Rethorst | 104/91 |
| 3,580,184 | 5/1971 | Giraud | 198/185 X |
| 3,631,806 | 1/1972 | Barthalon | 104/89 |
| 3,699,896 | 10/1972 | Giraud | 104/88 |
| 3,747,538 | 7/1973 | Giraud | 198/185 X |
| 3,771,463 | 11/1973 | Smoot et al. | 104/149 X |
| 3,791,304 | 2/1974 | Bardet et al. | 104/18 |
| 3,793,961 | 2/1974 | Salvadorini | 198/16 |
| 3,823,671 | 7/1974 | Straumsnes | 104/18 |
| 3,858,518 | 1/1975 | Nyman | 104/18 X |

FOREIGN PATENTS OR APPLICATIONS

| | | | |
|---|---|---|---|
| 518,644 | 1/1931 | Germany | 104/89 |

*Primary Examiner*—Robert J. Spar
*Assistant Examiner*—Randolph A. Reese

[57] ABSTRACT

A modular rapid transportation system is described which features transport modules for carrying passengers and/or freight, high-speed, constant-velocity conveyors for transporting the transport modules from station to station and variable-speed transfer vehicles at the stations capable of matching velocities with the high-speed conveyors for loading and unloading the transport modules onto and off of the conveyors. A station in the system is located between at least two oppositely-moving, constant-velocity conveyors and includes at least two closed-circuit, overhead rails above the constant-velocity conveyors.

The transfer vehicle travelling on a rail accelerates from a loading/unloading section of the rail with a transport module and matches the velocity of one of the constant-velocity conveyors, transfers the transport module to that conveyor and then moves to a storage section of the rail. The empty transfer vehicle then accelerates from the storage section of the rail, matches velocities with the oppositely-moving, constant-velocity conveyor, attaches to and removes a transport module from that conveyor, accelerates with the transport module back to the module-loading section of the rail.

A system of detectors located at each station provides signals, enabling automatic loading and spacing of modules on the conveyor. A manual override control system is provided for overriding the automatic system.

Inherent fail-safe design features are provided for preventing collision of transport modules during the loading and unloading processes.

26 Claims, 25 Drawing Figures

UNLOADING
LOADING
LOADING
UNLOADING

AT STATION

VB = VR

VB > VR
VR
VB
36
39
38
42
37
41
62
56
67
66
24
71
31
23
25
21
11

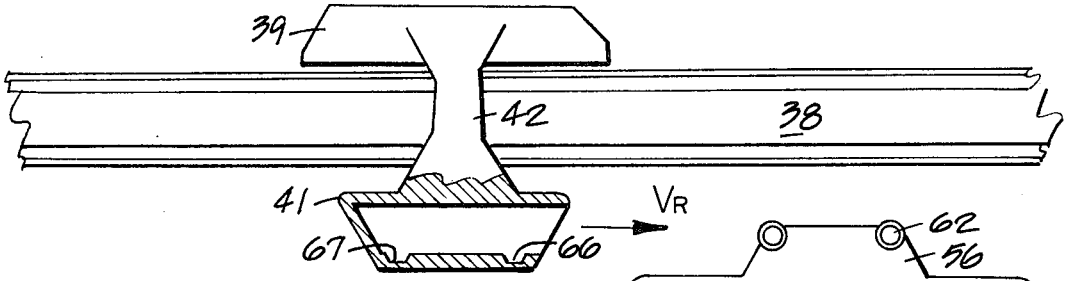
FIG. 10.
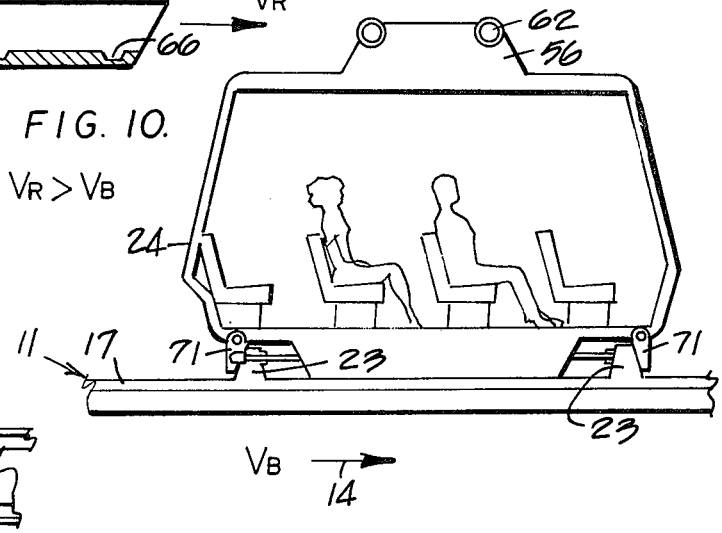
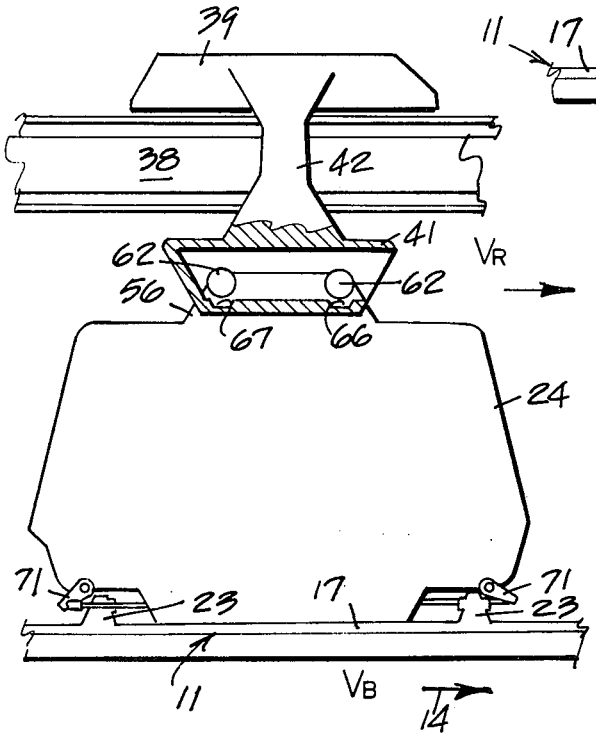
FIG. 11. VR = VB
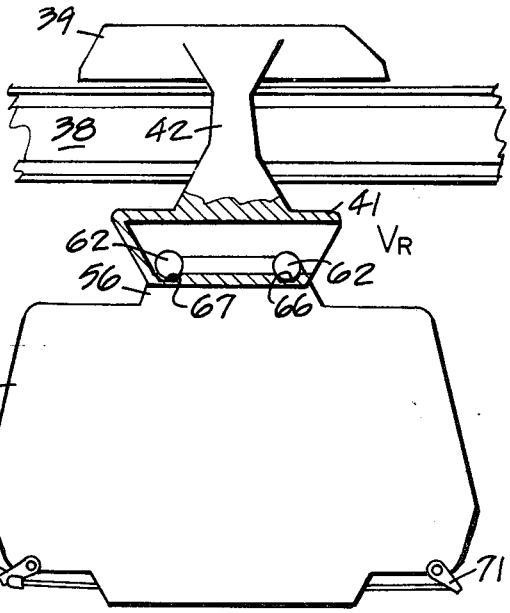
FIG. 12.
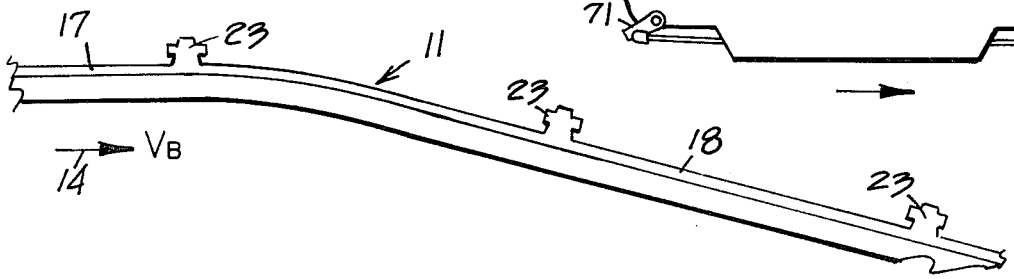

FIG. 13.
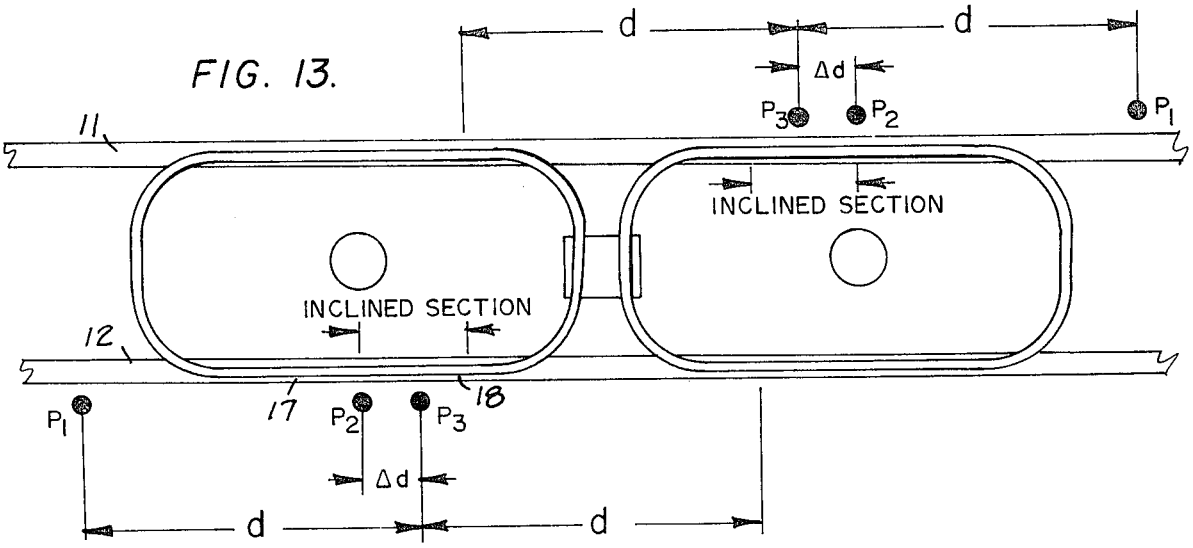
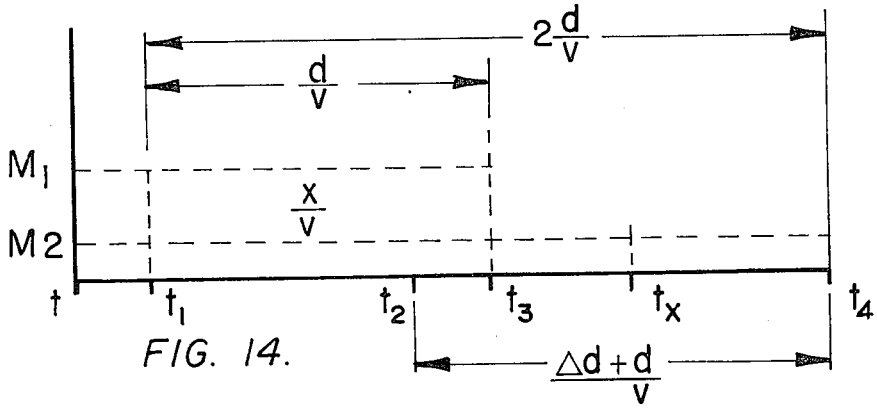
FIG. 14.
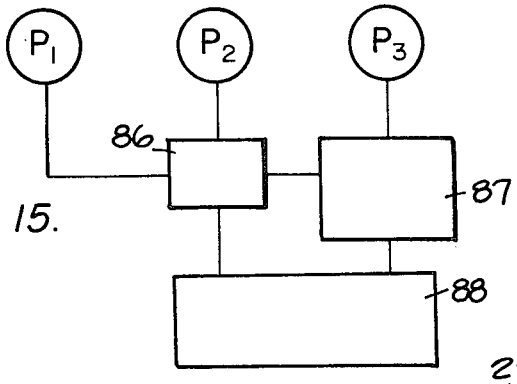
FIG. 15.
FIG. 16.
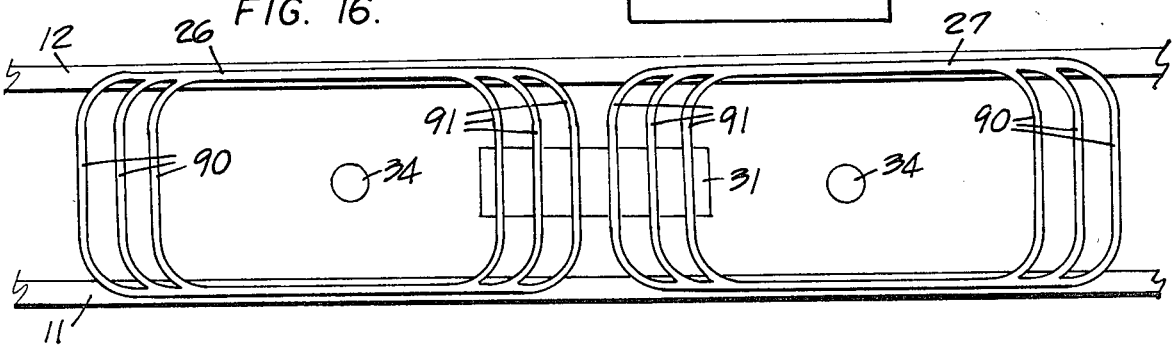

FIG. 21.
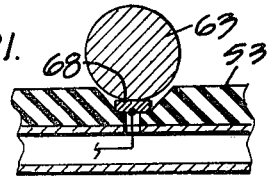
FIG. 18.
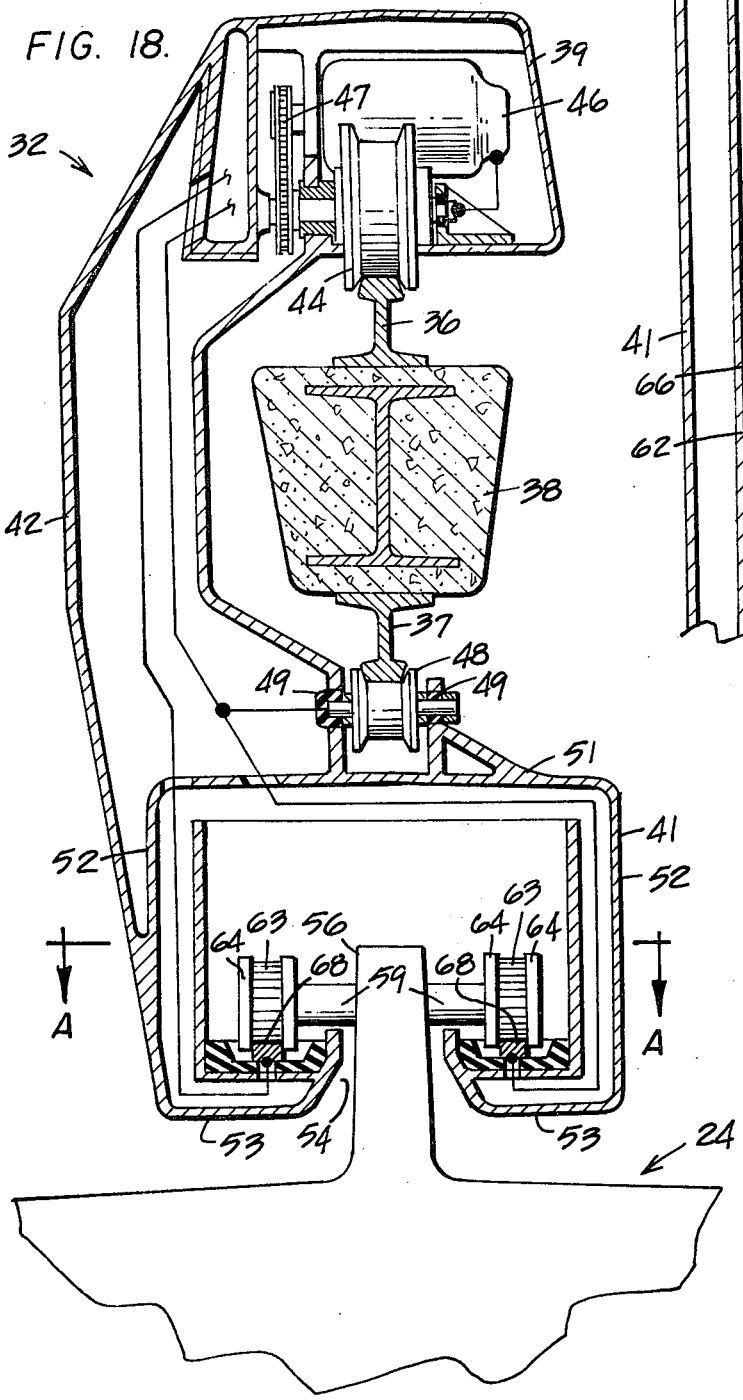
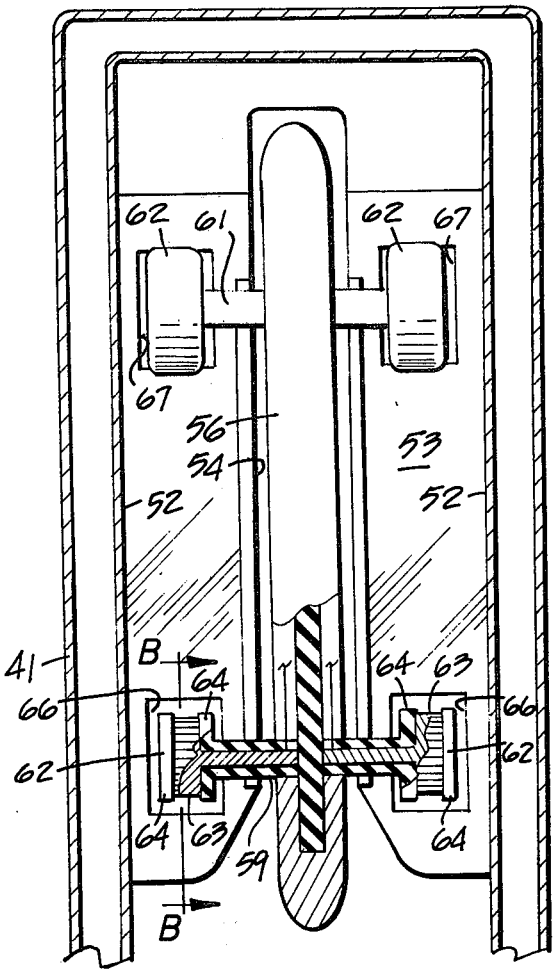
FIG. 20.
FIG. 19.
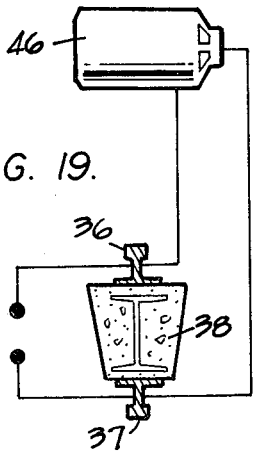

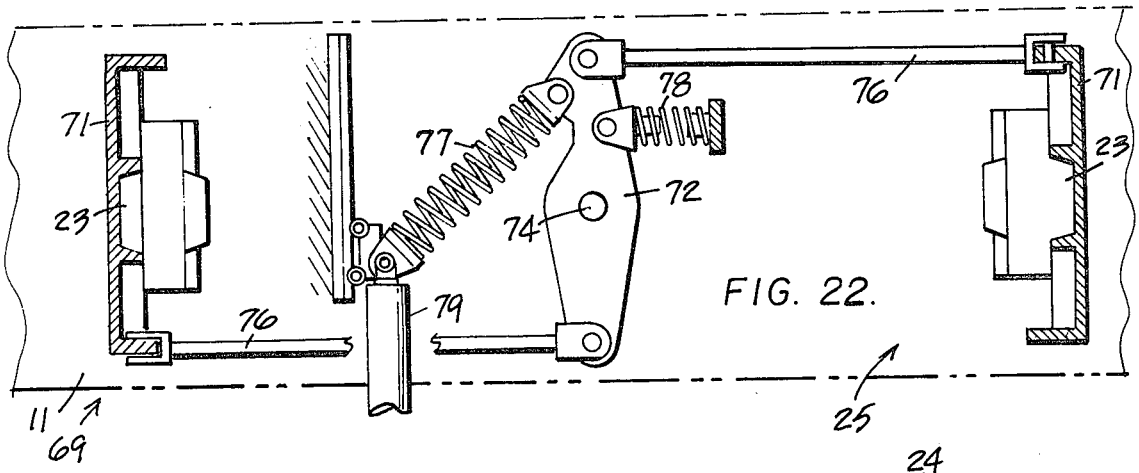
FIG. 22.
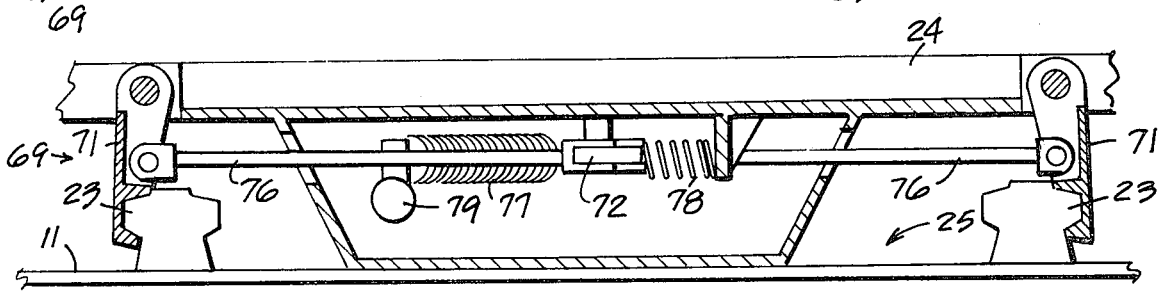
FIG. 23.
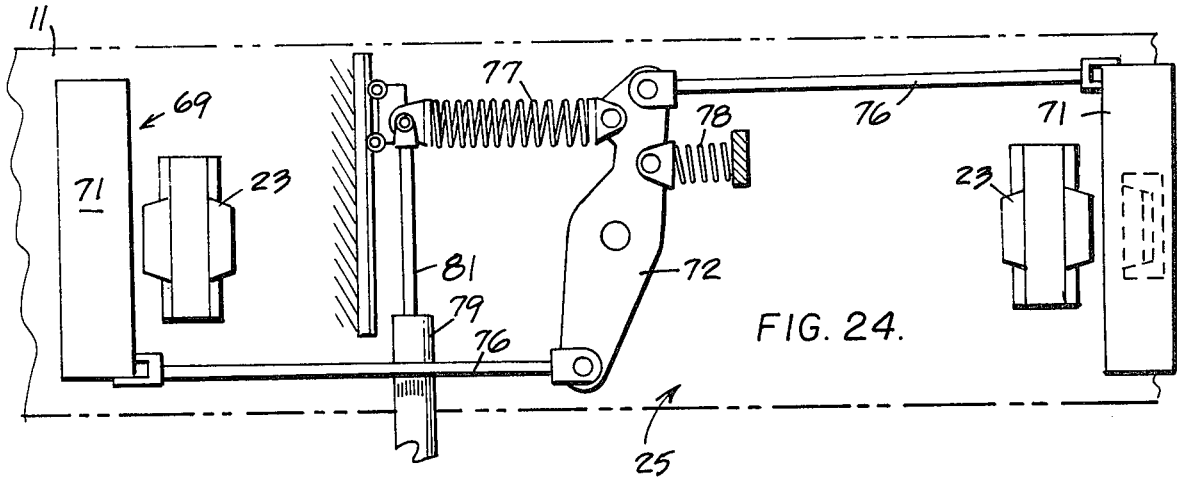
FIG. 24.
FIG. 25.
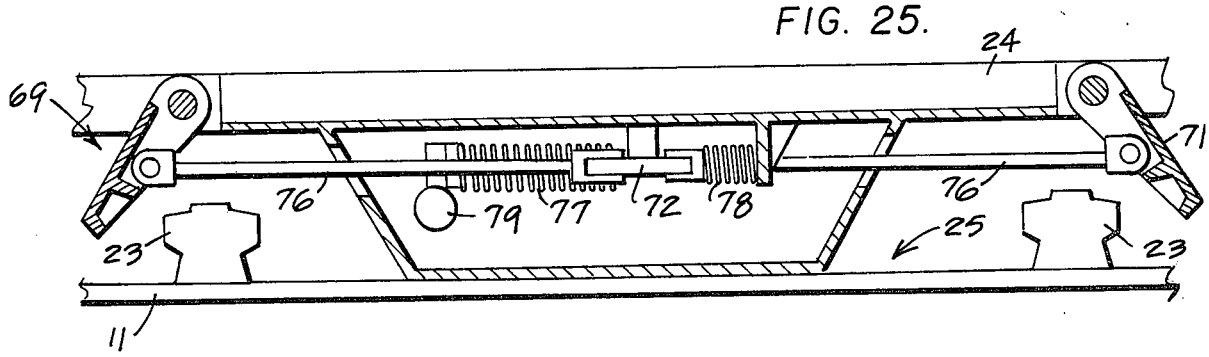

MODULAR RAPID TRANSPORTATION SYSTEM FOR PASSENGERS AND FREIGHT

BACKGROUND OF THE INVENTION

1. Field of the Invention

The invention relates to a high-speed, constant-velocity conveyor for conveying individual transport modules containing either freight or passengers and to apparatus and techniques for loading and unloading the transport modules onto and off of the high-speed conveyors.

2. Description of the Prior Art

Many attempts have been made for speedy transportation of passengers and freight on constant-velocity, high-speed conveyors. The inherent problem of such systems is that the load-carrying element of the system must be stopped or greatly slowed down before freight and/or passengers can be safely loaded onto or off of the moving system.

For example, U.S. patents falling into U.S. Classes 104/25, 198/16, and 198/110 and into International Classes B65G17/06, B65G21/12, and related classes, described continuously-moving sidewalk or platform systems for conveying passengers and freight. The platforms of such systems are generally designed to expand or contract in the direction of travel to provide high-velocity sections and low-velocity sections. Freight is placed on and removed and passengers embark on and disembark from the moving platforms in the low-velocity sections.

U.S. Pat. No. 3580182, issued to G. Bouladon and U.S. Pat. No. 3793961, issued to R. Salvadorini, described variable-speed transportation systems for conveying passengers from a stationary surface to a belt moving at a constant velocity. The disadvantages of the Bouladon and Salvadorini systems are as follows:

a. Ingress onto and egress from a constant-velocity belt is provided by structurally-complex, variable-velocity, continuously-moving conveyors.

b. The systems can only handle mobile freight capable of moving under its own power from one moving conveyor system to another moving conveyor system.

c. Passenger transfer between the constant-velocity conveyor and the ingress and egress conveyors depends upon the agility and balance of the passengers.

d. Passengers and freight must be transferred between the constant-velocity conveyor and the ingress and egress conveyors in relatively short time intervals.

Specifically, assuming that a person embarking or debarking from the constant-velocity conveyor is moving at 44 feet per second (30 miles per hour) and the transfer zone is 440 feet long, the passenger has only ten seconds to move from one conveyor belt to the other conveyor belt. Ten-second transfer time is clearly impractical and even impossible for many passengers, particularly the old, the young, the infirm and those who drop their umbrellas. To provide a reasonable transfer time of, for example, three minutes, for a 30 m.p.h. constant-velocity conveyor, would require a transfer zone 1.5 miles long, clearly an impractical alternative.

Also, stationary structures located at the respective ends of the transfer zones of prior art constant-velocity conveyors pose severe safety hazards for passengers who do not successfully transfer from one conveyor to the other or who attempt to transfer within the last second.

For the foregoing reasons, the prior art transportation systems having a constant-velocity conveyor and a variable-velocity conveyor which require passengers to physically move from one part of the system to the other, are both impractical and unsafe.

SUMMARY OF THE INVENTION

A modular transportation system is described in which modular units containing either freight or passengers are loaded onto and/or off of a constant-velocity conveyor by a plurality of variable-velocity transfer vehicles which accelerate to the velocity of the conveyor and release and/or secure transport modules. The transfer vehicles travel along a circular track between at least two constant-velocity conveyors moving in opposite directions. Specifically, a transfer vehicle transfers a transport module onto one constant-velocity conveyor and then removes a transport module from the oppositely-moving, constant-velocity conveyor.

The invented transportation system has many distinct advantages over other constant-velocity conveyor transportation systems. First, the transfer vehicles used for loading the transfer modules onto and off of the constant-velocity conveyors are relatively simple, self-powered, structural units travelling on a circular track.

Secondly, the use of transport modules eliminates the necessity of loading passengers onto or off of a moving component since the transport module can be brought to a halt for loading and unloading of passengers and freight.

Thirdly, the combination of a transport module and a transfer vehicle allows for automatic loading of the constant-velocity belt in relatively short times and distances (one to two seconds).

The system further includes detectors located adjacent an incoming, constant-velocity conveyor for determining the presence and spacing of transport modules on the constant-velocity conveyor. Signals from the detector system allow automatic loading of transport modules onto the constant-velocity conveyor by the transfer vehicles. The system further includes inherent, fail-safe design features to preclude catastrophic accident in case of malfunction during transfer of a transport module onto or off of the constant-velocity conveyors.

DESCRIPTION OF THE DRAWINGS

FIGS. 10, 11 and 12 show the sequence of a transfer from the constant-velocity conveyor to the variable-velocity transfer vehicle.

FIG. 13 is a diagram showing the location of detectors for determining the presence and spacing between transport modules on the constant-velocity conveyor in the station region.

FIG. 14 is a simple graph showing the time sequence of signals from the detectors triggered by two transport modules travelling on the constant-velocity conveyor.

FIG. 15 shows a simplified block diagram for processing signals from the detector.

FIG. 16 is a top-plan view of the track structure for the transfer vehicles having more than one track in the regions between the constant-velocity conveyors.

FIG. 18 is a cross-section of a variable-velocity transfer conveyor showing the engagement of the transfer vehicle with a transport module.

FIG. 19 is a simplified diagram showing how electrical current is delivered to the motor of the transfer vehicle.

FIG. 20 is a view taken along line A—A of FIG. 18.

FIG. 21 is a view taken along line B—B of FIG. 20.

FIGS. 22, 23, 24 and 25 show bottom and side views of the normally closed latching mechanism for securing a transport module to the constant-velocity conveyors.

DETAILED DESCRIPTION OF EXEMPLARY EMBODIMENT

Figures 1, 2, 3:
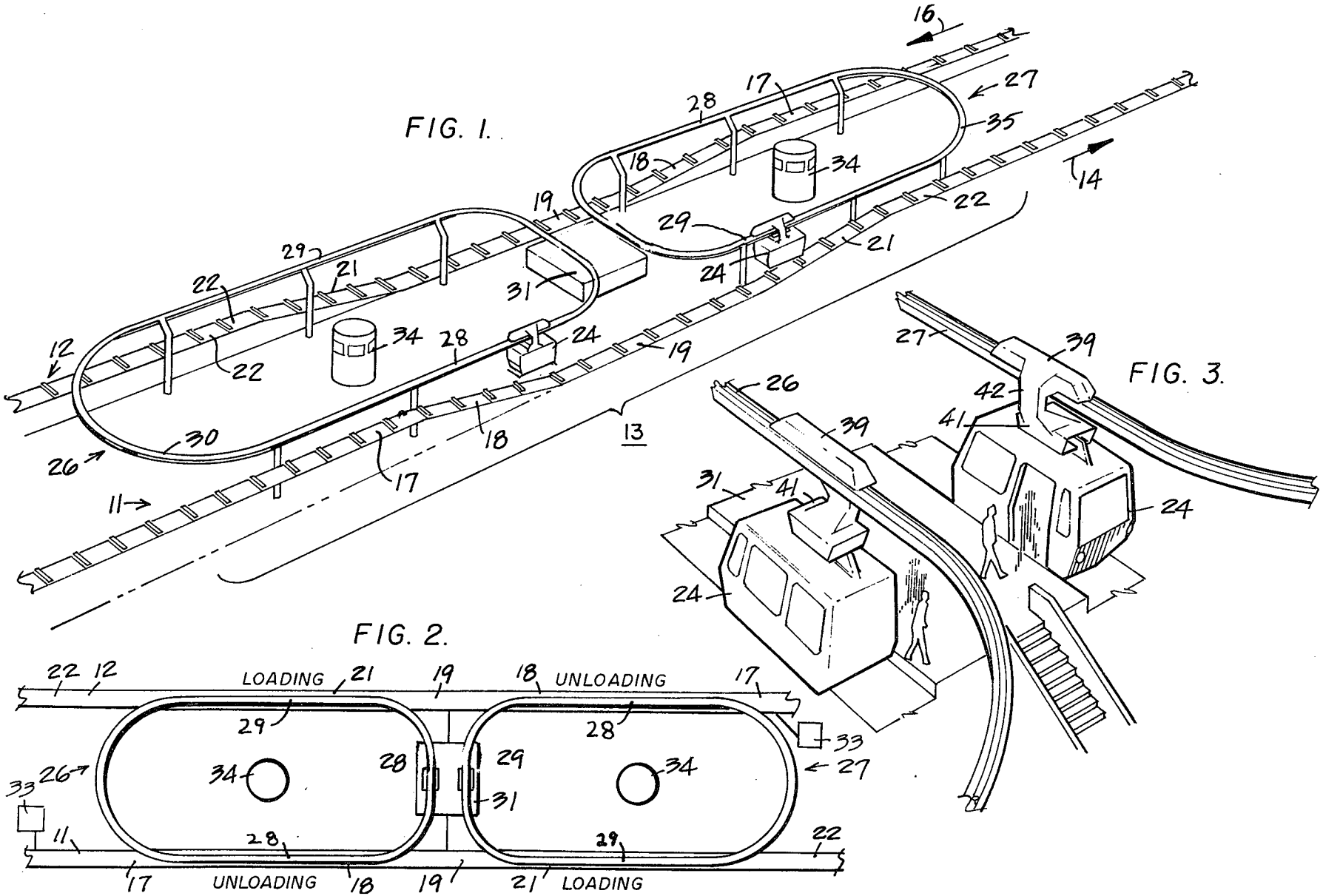
FIG. 1 is a simplified perspective view of a station of the invented transportation system showing the relationship between the constant-velocity conveyors and the transfer vehicles and transfer vehicle track.
FIG. 2 is a top view of a station for the invented transportation system.
FIG. 3 is an enlarged perspective view of the passenger loading/unloading platform.

Referring to FIG. 1, two constant-velocity transport conveyors, 11 and 12, are oriented substantially parallel to each other in a station region 13. The transport conveyors move at a constant velocity in opposite directions as indicated by the arrows 14 and 16.

As each constant-velocity conveyor 11 and 12 enters and exits from the statin region 13, they have, in sequence, an unloading section 17 at a first elevation, a downwardly-inclined section 18, a non-transfer section 19 at a second elevation, an upwardly-inclined section 21 and a loading section 22 at the same elevation as the unloading section 17. A plurality of latching shoulders 23 extend perpendicularly upward from the planer surfaces of the transport conveyors 11 and 12. The latching shoulders 23 define a plurality of adjacent receptacles 25 for receiving transport module 24 (see also FIG. 17.)

Between the constant-velocity transport conveyors 11 and 12, there are two track structures 26 and 27, which includes linear side sections 28 and 29 joined by curved end sections 30 and 35. As can be seen from FIG. 2, the linear section 28 of track structure 26 is disposed above the unloading section 17 and the downwardly-inclined section 18 and the non-transfer section 19 of transport conveyor 11, while the linear section 29 of track structure 27 is disposed above the non-transfer section 19, the upwardly-inclined section 21 and the loading section 22 of the same transport conveyor 11. On the other side, the linear section 28 of the track structure 27 is disposed above the unloading section 17, the downwardly-inclined section 18 and the non-transfer section 19 of the transport conveyor 12, while the linear section 29 of track structure 26 is disposed above the non-transfer section 19, the upwardly-inclined section 21 and the loading section of the same transport conveyor 12.

A station platform 31 is located between the adjacent ends of the track structures 26 and 27.

Auxilliary electrical current generators 33 are located at the distal ends of the track structures 26 and 27, each operatively coupled to one of the transport conveyors 11 and 12. The auxilliary electrical current generators supply the emergency electrical current for operating the transfer vehicles 32 in case of a power failure which only affects the station 13 but not the transport conveyors 11 and 12.

Control centers 34 are located within each track structure 26 and 27. An array of detectors $P_1$, $P_2$ and $P_3$, are located along the unloading sections and downwardly-inclined sections of the transport conveyors 11 and 12 for determining the presence, absence and spacing of transport modules 24 on the conveyors 11 and 12.

Figure 17:
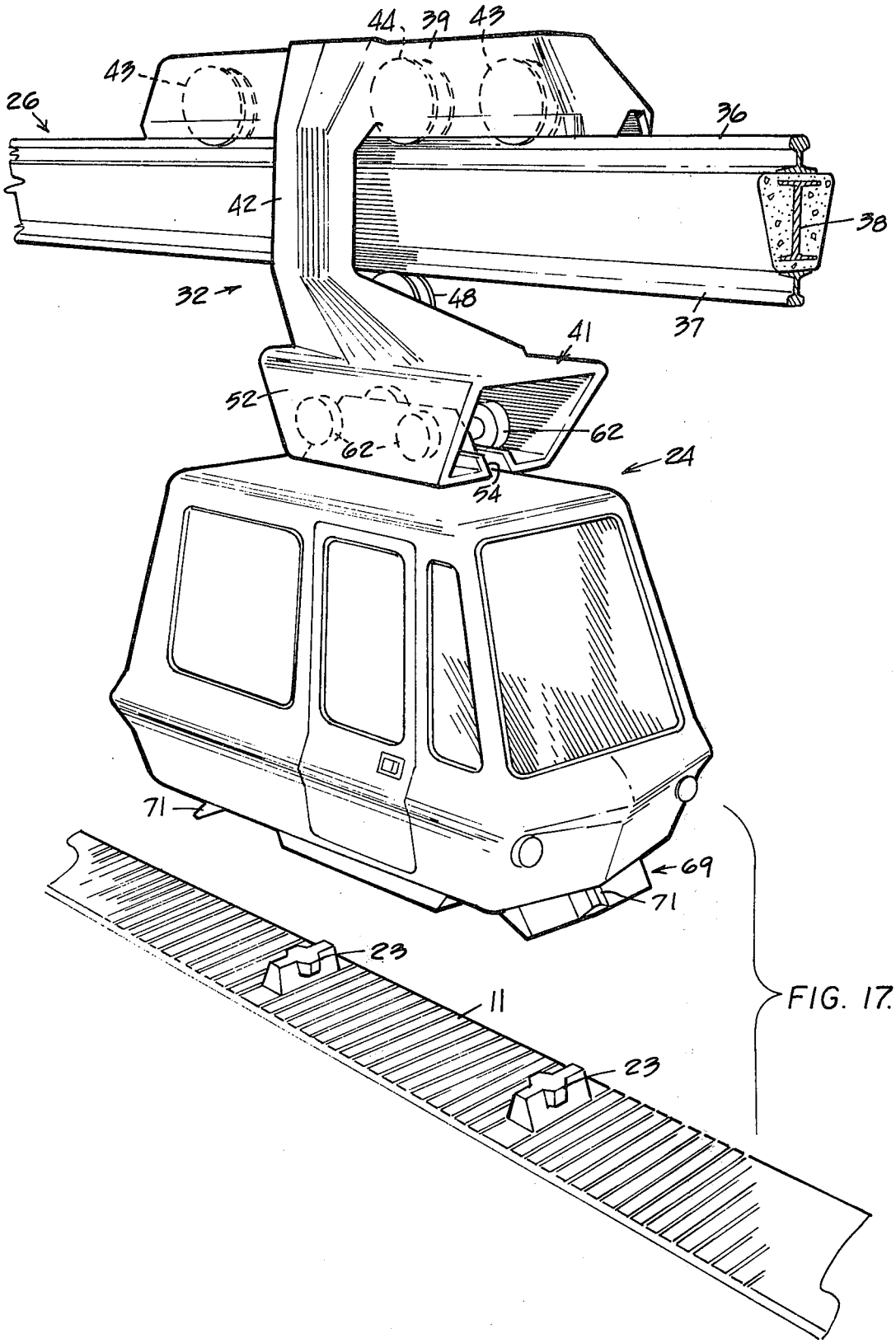
FIG. 17 is a perspective view of a transport module being carried by an overhead, variable-velocity transfer vehicle, the transfer vehicle track structure and a receptacle on the constant-velocity conveyor for receiving the transport module.

Referring now to FIGS. 17 and 18, the track structures 26 and 27 comprise a top rail 36 and a bottom rail 37 secured to opposite sides of a load-bearing rail 38. The transfer vehicle 32 is an integral structure including a motor housing 39, a transport module engagement housing 41, and a structural arm member 42, connecting the motor housing 39 and the transport module engagement housing 41. The motor housing is provided with rider wheels 43 to run on the top rail 36. A driver wheel 44 is also mounted in the motor housing 39 and engages the top rail 36. A direct-current, electrical motor 46 is suitably mounted in the motor housing 39 mechanically coupled to the driver sheel 44 for driving (rotating) the driving wheel 44. A conventional pulley/belt power transmission device 47 is shown coupling the motor 46 and wheel 44.

The transport module engagement housing 41 includes a trolley pulley 48 which runs on the bottom rail 37.

The primary purpose of the trolley pulley 48 is to maintain electrical contact with the bottom rail 37. The trolley pulley also serves to stabilize the carrier vehicle as it rolls along the rails 36 and 37. Electrical contact between the transfer vehicle 32 and the top rail 36 can be maintained by either one of the rider wheels 43 or the driver wheel 44.

Referring now to FIG. 19, a direct current electrical energy source is connected across the top and bottom rails 36 and 37 respectively. The direct current motor 46 is electrically connected by conventional means to the trolley pulley 48 and rider wheel 43. The trolley pulley 48 is electrically insulated from the remaining structure of the transfer vehicle by appropriate bearing structures 49. (FIG. 18)

Referring to FIGS. 17, 19 and 20, the transfer vehicle engagement housing 41 is a rectangular, tubular structure. The trolley pulley 48 is mounted on the top wall 51 of the housing 41. Two structural walls 52 extend perpendicularly downward from the top wall 51 to a support platform 53 to complete the tube structure. The support platform 53 has a slot 54 parallel to the axis of the tube adapted to accommodate the engagement structure 56 extending from the top of the transport module 24. The end of the tube structure of the transport module engagement housing 41 is open in the direction of travel of the transfer vehicles 32 hereinafter referred to as the front of the engagement housing 41. A back wall closes off the back end of the tubular housing.

The engagement structure 56 on top of the transport modules 24 basically comprises a longitudinal structural member integral with the transport module extending perpendicularly upward from the top of the transport module 24 and aligned with the direction of travel of the constant-velocity transport conveyors. The longitudinal structural member 56 supports two bars oriented perpendicularly with respect to its axis. Wheels 62 are mounted on the extending ends of the bars 59 and 61. The wheels on the front bar 59 include, in axial alignment, a cylindrical, electrical contact 63 sandwiched between two annular shoulders 64 composed of an insulative structural material. The annular shoulders 64 have a greater outside diameter than the cylindrical contact 63.

The support platform 53 includes two front receptacles 66 and two back receptacles 67 such that when the transfer vehicle 32 is carrying the transport module 24, the wheels 62 are received in the respective receptacles 66 and 67. The front receptacles 66 have appropriate electrical connectors 68 designed to make an electrical connection with the cylindrical contact 63 of the front wheels 62. Each electrical connector 68 is appropriately insulated and electrically connected by conventinal means to one of the rails 36 or 37 through the rider wheel 43 and trolley pulley 48 respectively.

The primary purpose of the cylindrical contacts 63 and the electrical connectors 68 is to supply electrical energy to the transport module 24 for energizing a latching mechanism 69 securing it to the constant-velocity conveyors 11 and 12. (See FIG. 17).

More specifically, as shown in FIGS. 22, 23, 24 and 25, the latching mechanism 69 for securing the transport modules 24 to the constant-velocity conveyors 11 and 12 includes two latching structures 71 adapted to mate with the latching shoulders 23 on the constant-velocity conveyors 11 and 12. The latching structures 71 are pivotally-mounted at each end of the transport module 24. A lever arm 72 is mounted on the bottom of the transport module 24 and is adapted to pivot in a plane parallel the bottom of the transport module 24. The distal ends of the lever 72 are mechanically-linked to the latching structures 71 by the rods 76. The latching mechanism 69 is biased in a normally closed position by the springs 77 and 78 as shown in FIGS. 22 and 23. The latching mechanism 69 is opened by a push-rod mechanism 79.

More specifically, the push-rod mechanism 79 is mechanically coupled to one end of the lever 72. As shown in FIG. 22, when the push-rod mechanism 79 is not energized, the spring 77 is in tension and tends to rotate the lever 72 in a counter-clockwise direction. Upon energizing the push-rod mechanism 79, the rod 81 extends translating the axis of the spring 77 to the opposite side of the lever pivot point 74 and places the spring 77 in compression, thereby forcing the lever 72 to rotate in a clockwise direction as shown in FIG. 24. The connector rods 76 coupling the lever 72 to the latching structure 71 cause the latching structures to pivot outward, releasing the latching shoulder 23 when the lever 72 is rotated in a clockwise direction. (See FIG. 25). The spring 77 should have sufficient force when the mechanism 79 is energized to overcome the resistance of the biasing spring 78 and the weight of the latching structures 71. When the push-rod mechanism 79 is not energized, the spring 77 is placed in tension which, together with the biasing spring 78, makes the latching mechanism 69 a normally closed latching mechanism.

As shown, the push-rod mechanism 79 is a solenoid-type mechanism and is electrically connected to the cylindrical contacts 63 (FIG. 20) by conventional means. Accordingly, the transport module 24 is secured by the latching mechanism 69 to the constant-velocity conveyors 11 or 12 until the cylindrical contacts 63 make electrical contact with the electrical connector means 68 in the front receptacle 66 of the support platform 53 of the transfer vehicle 32.

Figure 4:
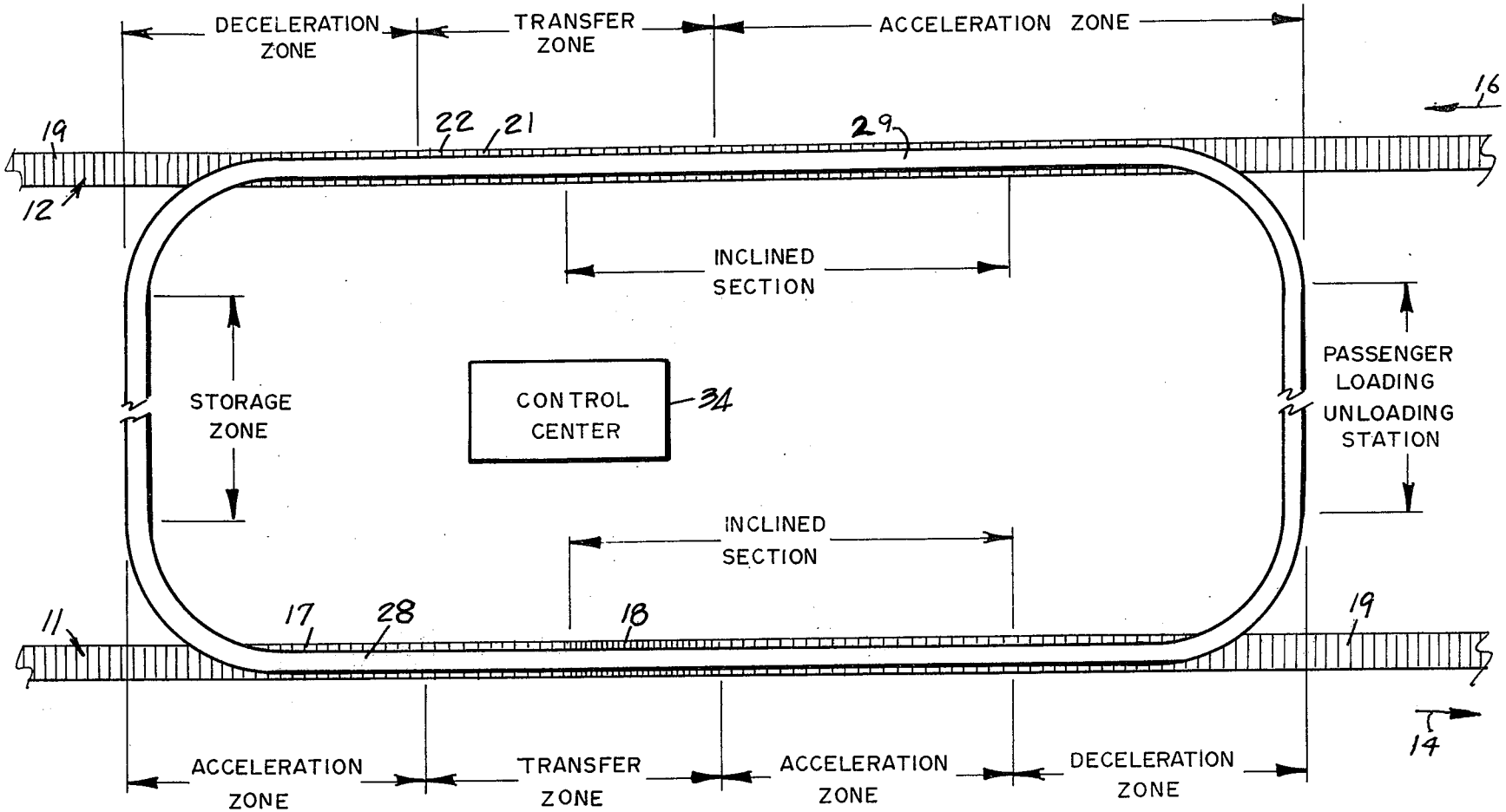
FIG. 4 shows the relationship between the different zones along the transfer vehicle track and the constant-velocity conveyors.
Figures 5, 6:
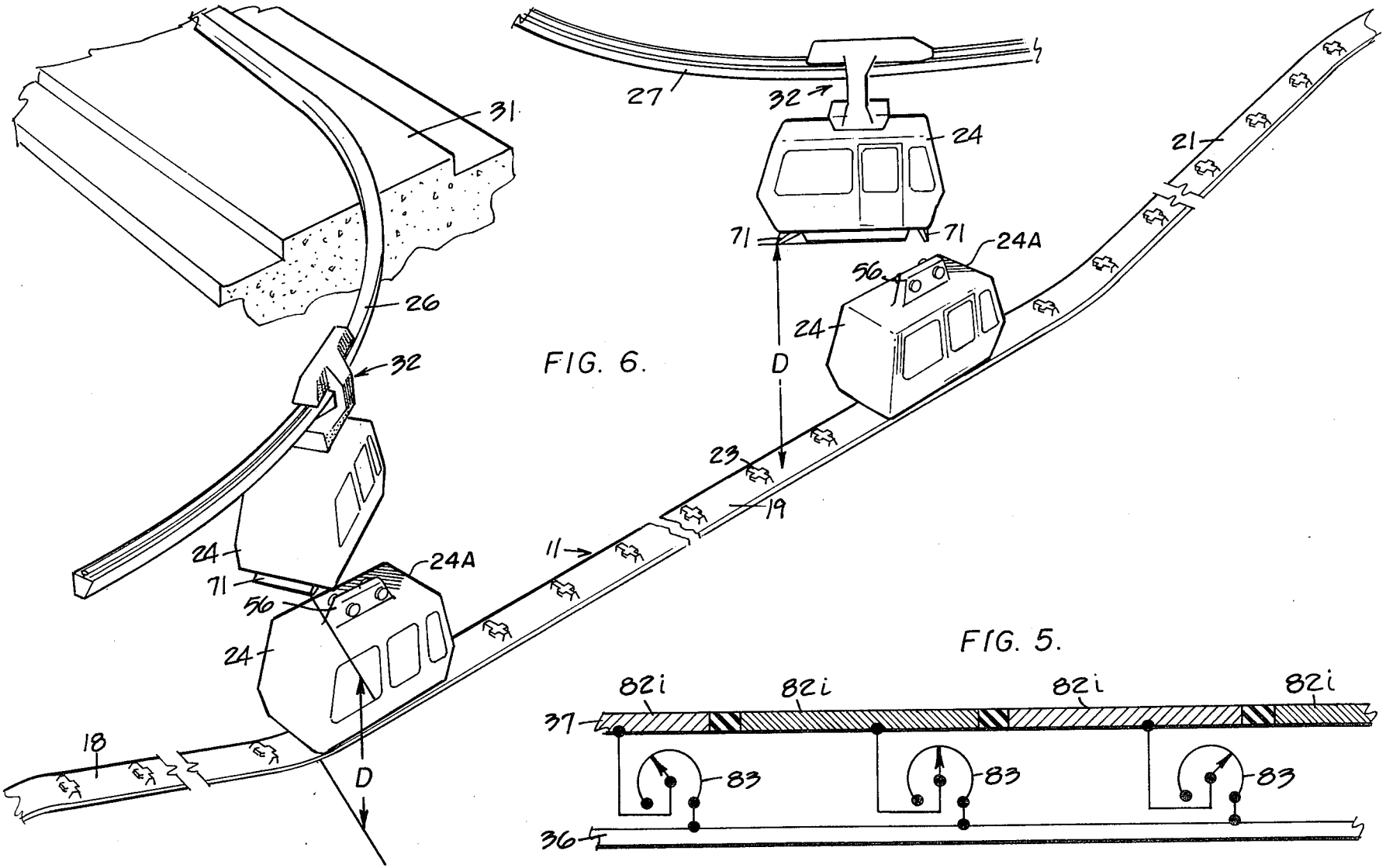
FIG. 5 is a diagrammatic view of a simplified form of an electrical circuit for controlling electrical current supplied to the rails upon which the variable-speed transfer vehicles travel.
FIG. 6 is a side view of the transportation system in the station region showing the relationship between transport modules being carried by a transfer vehicle and transport modules being carried on the constant-velocity conveyor.

Referring now to FIGS. 4 and 5, the bottom rail 37 of the track structure 26 is divided into a plurality of segments **82*i* each electrically-insulated from the remaining segments. A direct-current, electrical-energy source (not shown) is connected between the top rail 36 and each segment 82*i* of the bottom rail 37. Specifically, the top rail is electrically connected to one terminal of a direct-current energy source and each segment 82*i* of the bottom rail 37 is connected to the other terminal. Means are provided for regulating the amount of electrical current which can flow between each segment of the lower rail 37 and the top rail when the transfer vehicle 32 makes an electrical connection between the respective segments 82*i* and the top rail 36. Such means are symbolically shown in FIG. 5 as current regulators 83. The current regulators 83** may comprise rheostats or other conventional electronic current regulators.

Conventional electronic automatic controls may be used to adjust the current regulators 83. Also, conventional manual adjustment means can be provided to supplement the automatic control means for adjusting the current regulators 83. Such manual control means for adjusting the current regulators 83 should be located in the control center 34.

Referring to FIG. 4, each segment **82*i* of the lower rail 37 defines a speed zone for the transfer vehicle 32 travelling on the track structures 26 and 27. Specifically, on the loading side of the track structures 26 and 27 there is an acceleration zone, a transfer zone and a deceleration zone. On the unloading side of the track structures 26 and 27, there is an acceleration zone, a transfer zone, a second acceleration zone and a deceleration zone. In the portions of the track structures 26 and 27 adjacent the station platform 31, current regulators 83 are provided for reducing current flow between the segments 82 and the top rail 36 to zero and for reversing the direction of current flow for braking purposes. Similar current regulators 83 are provided in the storage region of the track structure distant from the station platform 31. Accordingly, the transfer vehicles 32 can be brought to a halt for loading and unloading passengers and freight at station platform 31** and in the storage zone.

On the loading sides of the track structures 26 and 27, the acceleration zone located above the non-transfer section 19 and approximately two-thirds of the upwardly-inclined sections 21 of the constant-velocity conveyors 11 and 12. In the acceleration zone on the loading side of the track structures 26 and 27, the transfer vehicle 32 carrying a transport module 24 accelerates to a velocity at least equal to the velocity of the constant-velocity conveyors 11 and 12 thereunder.

The transfer zone on the loading side of the track structures 26 and 27 is located above the remaining third of the upwardly-inclined sections 21 and a first portion of the loading sections 22 of the constant-velocity conveyors 11 and 12. In the transfer zone on the loading side of the track structures 26 and 27, the transfer vehicle 32 still carrying the transport module 24 matches or adjusts to the velocity of the constant-velocity conveyors 11 and 12.

The deceleration zone on the loading side of the track structures 26 and 27 is located above the remainder of the loading sections 22 of the constant-velocity conveyors 11 and 12. In the deceleration zone on the loading side of the track structures 26 and 27, the transfer vehicle slows down to a velocity less than the velocity of the constant-velocity conveyors 11 and 12 such that the conveyors carry the transport module 24 away from the transfer vehicle 32.

The transfer vehicle then moves into the storage zone of the track structures 26 and 27 where it is stopped possibly along with other transfer vehicles 32.

On the unloading side of the track structures 26 and 27, there is a first acceleration zone located above the first portion of the unloading sections 17 of the constant-velocity conveyors 11 and 12. In the first acceleration zone, the transfer vehicle 32 accelerates to a velocity slightly greater than the velocity of the constant-velocity conveyors 11 and 12.

On the unloading side of the track structures 26 and 27, the transfer zone is located above the remainder of the unloading sections 17 and approximately one-third of the downwardly-inclined sections 18 of the constant-velocity conveyors 11 and 12. In the transfer zone, the transfer vehicle 32 matches velocity with the constant-velocity conveyors 11 and 12 and the engagement housing 41 of the transfer vehicle 32 secures the engagement structure 56 of the transport module 24.

A second acceleration zone on the track structures 26 and 27 is provided immediately after the transfer zone and is disposed above the remainder of the downwardly-inclined sections 18 of the constant-velocity conveyors 11 and 12. In the second acceleration zone, the transfer vehicle 32 accelerates with the transport module 24 to a velocity greater than the velocity of the constant-velocity conveyors 11 and 12.

A deceleration zone on the unloading sides of the track structures 26 and 27 is located between the second acceleration zone and the station zone above the non-transfer sections of the constant-velocity conveyors 11 and 12. In the deceleration zone on the unloading side of the track structures 26 and 27, the transfer vehicle 32 slows down to a velocity less than that of the constant-velocity conveyors 11 and 12.

In the station zones of the track structures 26 and 27, the transfer vehicle 32 carrying the transport module 24 is brought to a halt possibly with other transfer vehicles 32 and modules whereupon passengers and freight are unloaded therefrom and other passengers and/or freight can be loaded into the transport modules 24 for placement onto the oppositely-moving, constant-velocity conveyor 11 or 12.

Figures 7, 8, 9:
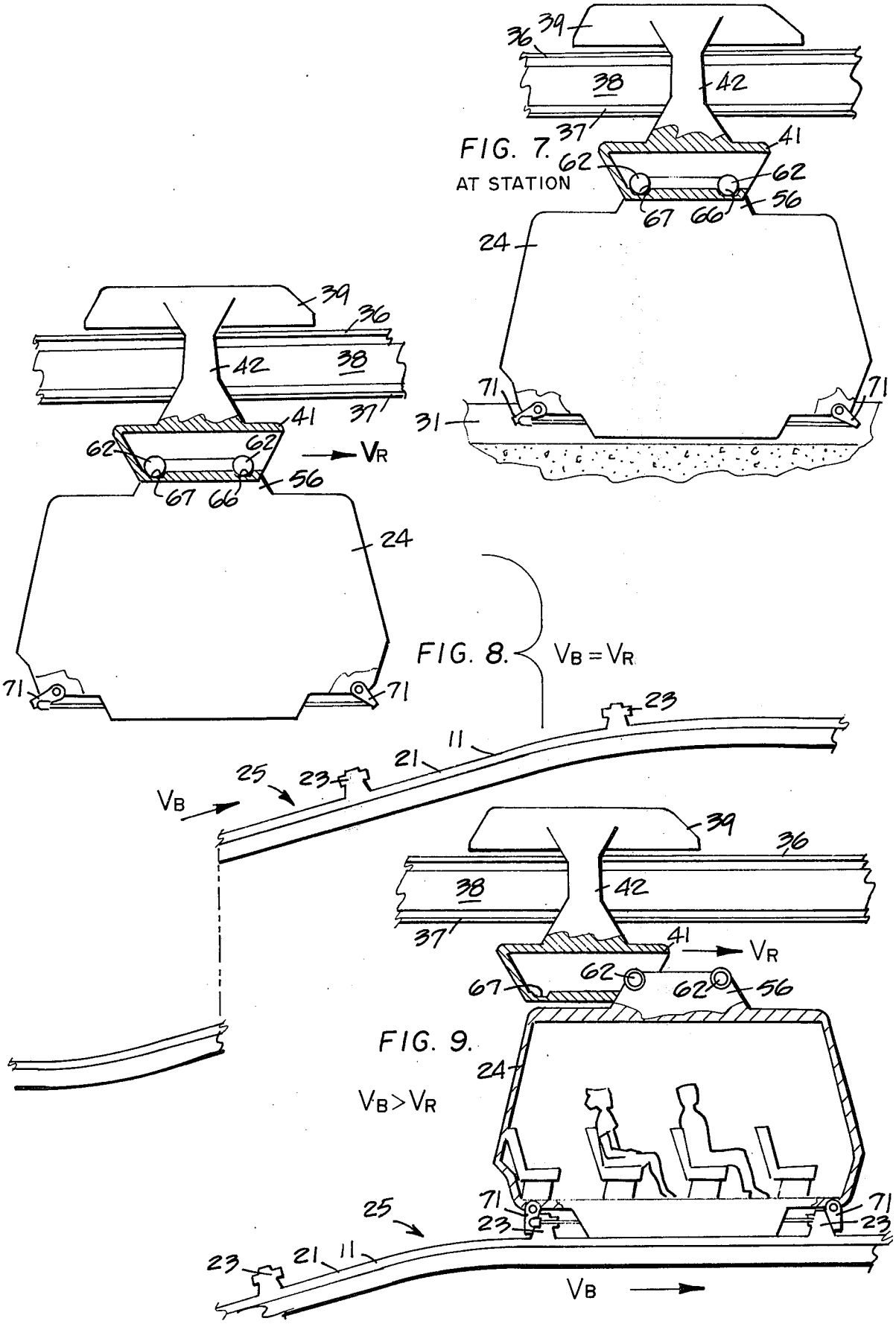
FIGS. 7, 8 and 9 show the sequence of transfer of a module from the variable-speed transfer vehicle to the constant-velocity conveyor.

In more detail, FIGS. 7, 8 and 9 depict the sequence of loading a transport module 24 onto a constant-velocity conveyor 11 or 12. FIG. 7 shows a transfer vehicle 32 at the station.

In the acceleration zone and at the beginning of the transfer zone, the velocity of the constant-velocity conveyor 11 or 12 is always slightly greater than the velocity of the transfer vehicle 32 carrying the transport module 24. Accordingly, the receptacle 25 defined by the latching shoulders 23 on the constant-velocity conveyor 11 or 12 is overtaking the transport module 24 carried by the transfer vehicle 32.

FIG. 8 depicts a point just before engagement between the transport module 24 and a receiving receptacle 25 on a constant-velocity conveyor 11 or 12. It should be noted that the engagement point is still within the upwardly-inclined sections 21 of the conveyors 11 and 12. The velocity of the transport module 24 being carried by the transfer vehicle 32 is equal to the velocity of the conveyor 11 or 12. The conveyor 11 or 12 then moves up the remaining portion of the upwardly-inclined section 21 onto the loading section 22 lifting the engagement structure 56 of the transport module 24 out of engagement with the support platform 53 in engagement housing 41 of the transfer vehicle 32.

FIG. 9 depicts a point in the deceleration zone where the transfer vehicle 32 slows down to a velocity less than that of the constant-velocity conveyor 11 or 12 such that the conveyor carries the transport module 24 away from the transfer vehicle 32.

The sequence for unloading a transport module 24 from the constant-velocity conveyors 11 and 12 is depicted in FIGS. 10, 11 and 12. Specifically, FIG. 10 depicts a transfer vehicle 32 overtaking a transport module 24 carried on a constant-velocity conveyor 11 or 12. FIG. 11 depicts the point in a transfer zone on the unloading side of the track structures 26 or 27 where the transfer vehicle 32 has overtaken the transport module 24 carried by the conveyor 11 or 12 and the engagement structure 56 of the transport module is received in the slot 54 defined by the support platform 53 in the engagement housing 41 of the transfer vehicle 32. However, since the transport module 24 is still in the unloading section 17 of the conveyor 11 or 12, neither the front wheels nor the back wheels 62 are received in the receptacles 66 and 67 of the engagement structure 56. The electrical current supplied to the top rail 36 and the lower rail segment **82*i* should be sufficient to propel the transfer vehicle 32 at a velocity slightly greater than the velocity of the conveyor thereunder to hold the closed end of the slot 54 in engagement with the back end of the engagement structure 56**.

FIG. 12 depicts the transfer vehicle 32 transport module 24 and constant-velocity conveyor 11 or 12 at the end of the transfer zone on the unloading side of the track structure 26 or 27. Specifically, the constant-velocity conveyor 11 or 12 moves down the downwardly-inclined section 18 bringing the front bar 59 and wheels 62 of the engagement structure 56 of the transport module 24 into engagement with the front receptacles 66 of the engagement housing 41 of the transfer vehicle 32. Accordingly, electrical contact is made between the cylindrical contacts 63 and the electrical connectors 68. The push-rod mechanism 79 is energized, rotating the latching structure 71 outward, thus releasing the transport module 24 from the constant-velocity conveyor 11 or 12. The transfer vehicle 32 then accelerates away at a velocity greater than the velocity of conveyor 11 or 12.

As shown in FIG. 6, a transport module 24 carried by a transfer vehicle 32 in the acceleration zones on the loading side and in the deceleration zones on the unloading sides of the track structures 26 and 27 are a sufficient distance D above the non-transfer section 19 of the constant-velocity conveyor 11 and 12 such that the conveyor can convey a transport module 24A beneath the transport module 24 carried by the transfer vehicles 32. Accordingly, a collision between a transport module being carried by a transfer vehicle and a transport module being carried by a constant-velocity conveyor can only occur in the inclined sections 18 and 21 of the constant-velocity conveyor 11 and 12. However, such collisions can only occur in the event a transfer vehicle 32 malfunctions.

If a transfer vehicle carrying a transport module malfunctions above the inclined sections 18 and 21, it would be moving at a velocity approximately equal to the velocity of a transport module carried by the conveyor. Accordingly, a collision would not generate a large magnitude impact but rather simply amount to a pushing engagement between the respective transport modules.

Specifically, in the event of a malfuntion on the unloading side of the track structures 26 and 27, the transport module 24 carried by the constant-velocity conveyor 11 or 12 would essentially shove the transport module carried by the transfer vehicle 32 until the transport module 24 carried by the conveyor could move under the transport module carried by the transfer vehicle 32. On the loading side of the track structures 26 and 27, the transport module 24 carried by the constant-velocity conveyor 11 or 12 would shove the transport module 24 carried by the transfer vehicle up the upwardly-inclined section 21 until the module is lifted out of engagement with the transfer vehicle, whereupon the latching structures 71 engage the latching shoulders 23 on the constant-velocity conveyor 11 or 12. Side rails or wall structures can be placed along the sections of the constant-velocity conveyors 11 and 12 in the transfer zones to provide additional stabilization of the transport modules as they are placed onto and lifted off of the conveyors.

The invented modular transportation system is a multistationed system. Accordingly, each transport module 24 loaded onto a constant-velocity conveyor must have some means for identifying itself to the station where it is to be unloaded. A suggested destination identifier for the transport module would be a highly-directional FM signal generator carried by the transport module which broadcasts a highly directional short range FM signal perpendicular to the direction of travel of the module on the conveyor. The FM signal would be received by a detector a suitable distance before the station beside the incoming conveyor. Accordingly, as a transport module approaches the station for which it is destined, the FM signal broadcast therefrom would signal the station that it is the station for which it is destined. The FM receiving detector could then activate photoelectric switching mechanism immediately downstream to provide a timing signal to the automatic control system whereby the lower rail segments 82*i* on the unloading side of the track structure are energized such that the transfer vehicle 32 accelerates and overtakes the transport module as it enters the transfer zone.

To provide adequate spacing between transport modules 24 loaded onto the conveyors 11 and 12 for safety purposes, a detection system is placed adjacent the incoming conveyor for determining the presence of and spacing of transport modules on the particular conveyor.

Specifically, referring to FIG. 13, the detectors are located at three stations, $P_1$, $P_2$ and $P_3$, adjacent the incoming conveyors 11 and 12. Station $P_3$ is located beside the downwardly-inclined section 18 of the constant-velocity conveyors 11 and 12 such that a transport module 24 unloaded from the conveyor will not generate a signal. The detector station $P_2$ is located at the end of the unloading section 17 of the incoming conveyor. The detector station $P_1$ is located a distance (d) upstream the conveyor from station $P_3$ where d is the minimum safe-spacing distance between transport modules on the conveyor. Photoelectric cells would be suitable detectors for the detector stations $P_1$, $P_2$ and $P_3$.

With the detection system depicted in FIG. 13, if two or more transport modules $M_1$, $M_2$... $M_n$ carried by an incoming conveyor, $M_1$ will generate a signal, in sequence, at $P_1$ and then $P_2$, the time interval $T_a$ between the signal from $P_1$ and $P_2$ equals the time interval it takes the transport module to move a distance $(d-\Delta d)$ where $\Delta d$ is the distance between detector stations $P_2$ and $P_3$. Mathematically: $T_a=(d-\Delta d)/v$ where $v$ is the velocity of the constant-velocity conveyor. If $M_1$ is then unloaded, no signal is generated at station $P_3$. If $M_1$ is not unloaded, then $P_3$ wili provide a signal at $T_b$ where $T_b=d/v$.

Assuming now that $M_2$ is distance $d$ behind $M_1$, then a third signal will be generated at station $P_1$ at a time interval $T_c$ after the signal at $P_2$, where $T_c=\Delta d/v$. (Note $T_a+T_c=T_b$). Where there is no signal from $P_3$, the second signal from $P_1$ triggers the switching and logic circuitry of the automatic control system for the lower track segments 82*i* on the loading side of the adjacent track structure whereby a carrier vehicle carrying a transport module is appropriately accelerated for placement of the latter module in the spot vacated by the transport module $M_1$.

Where transport modules $M_1$ and $M_2$ are distance X apart, where X is greater than $d$ but less than $2d$, a transport module cannot be safely loaded onto the conveyor between $M_1$ and $M_2$. This situation is identical to the situation where $M_1$ and $M_3$ are a distance less than $2d$ apart and $M_2$ is unloaded. The sequence of signals generated by the detection system under such circumstances are as depicted in FIG. 14.

Specifically, $M_1$, as it passes by the detection station $P_1$, $P_2$ and $P_3$, will generate three signals at $T_1$, $T_2$ and $T_3$ respectively. The time interval between $T_1$ and $T_3$ is equal to $d/v$ where $v$ is the velocity of conveyor. The second module $M_2$ will generate a signal at time $T_x$ at detector station $P_1$ where the time interval between $T_1$ and $T_x$ equals $x/v$ where $x$ is the distance between the modules $M_1$ and $M_2$.

A suggested circuitry system for processing the signals from the detector stations $P_1$, $P_2$ and $P_3$ is depicted in the block diagram of FIG. 15. Specifically, the signal from $P_2$ is utilized to open up a gating circuit 86 between detector station $P_1$ and coincidence circuitry 87. The gating circuitry 86 remains open for a time interval $(d+\Delta d)/v$. As shown on the time sequence graph of FIG. 14, the gate of the circuitry 86 closes at time $T_4$ where the time interval between $T_1$ and $T_4$ equals $2d/v$. The signal from detector station $P_3$ is directly input into the coincidence circuitry 87. Since the coincidence circuitry 87 receives a signal from $P_1$ and $P_3$ within the prescribed interval of the gating circuit 86, it will generate a signal at its output to the control circuitry 88 for preventing energizing of the loading track segments 82*i* on the adjacent track structure.

In circumstances where transport modules $M_1$ and $M_2$ are distance X apart, where X is less than $(d-\Delta d)$, i.e., less than the distance between detector stations $P_1$ and $P_2$, then there will be two signals from station $P_1$ before there is a signal from station $P_2$. In such an event, the double signal from $P_1$ can be used to interrupt the loading sequence on the adjacent track structure.

In circumstances where the distance X between the transport modules $M_1$ and $M_2$ is $(d - \Delta d) < x < d$ and $M_1$ is left on the conveyor, then the coincidence circuitry 87 will generate a signal for preventing the loading of a module on the adjacent track structure 27.

Ideally, there should be a short holding section located between the station loading zone and the acceleration zone on the loading side of the track structures 26 and 27 such that the transfer vehicle 32 carrying a module 24 moves out onto the linear sections 29 of the track structures from the station loading zone and stops until the control circuitry energizes the lower rail segments 82*i*. Similarly, a second holding zone for the empty carrier vehicles 32 should be provided between the storage zone of the track structures 26 and 27 and the first acceleration zone on the unloading side of the structures. In this case, the holding zone at the end of the storage zone should not be part of the linear sections 28 of the track structures 26 and 27 because the engagement structure 56 of the modules carried by the conveyors 11 and 12 would collide with the engagement housing 41 of the carrier vehicles 32.

FIG. 16 depicts a top view of a station along the invented transportation system wherein multiple tracks 90 and 91 are provided in the storage and loading/unloading zones respectively of the track structures 26 and 27. Such multiple tracks would be useful at high-density freight-commuter stations, and end stations where a large number of carrier vehicles are required for loading and unloading transport modules from the conveyors. Appropriate electronic switching circuitry and mechanical rail switching devices are utilized to prevent collisions and the like between carrier vehicles in the multiple track storage zones 90 and loading/unloading zone 91.

The invented modular transportation system is described with respect to exemplary representative and schematic embodiments and numerous variations and modifications of the invented system can be effected within the spirit and the scope of the invention as described herein and as defined and set forth in the appended claims.

I claim:

1. A transportation system for conveying passengers and freight comprising in combination, a plurality of passive transport modules for receiving passengers and freight, a first constant-velocity conveyor means for receiving and carrying said transport modules at a velocity in a first direction, a second constant-velocity conveyor means for receiving and carrying said transport modules at a velocity in a second direction opposite said first direction, said second conveyor means being oriented in a spaced-apart, substantially parallel relationship with said first conveyor means in a station region, a first transfer means for removing transport modules from the first constant-velocity conveyor means and carrying them to a loading/unloading platform located between said first and second conveyor means in the station region and for placing said transport modules removed from said first constant-velocity conveyor means onto said second constant-velocity conveyor means, a second transfer means for removing transport modules from said second constant-velocity conveyor means and carrying them to said loading/unloading platform and for placing said transport modules from said second constant-velocity conveyor means onto said first constant-velocity conveyor means wherein the first and second transfer means each include a continuous rail structure located between said first and second constant-velocity conveyor means in the station region, said continuous rail structure having a first and second linear section, each linear section being disposed parallel to and above one of said constant-velocity conveyor means, a plurality of independent transfer vehicles each adapted to travel on said continuous rail structure and having means for attaching to and releasing said transport modules, and driving means for individually accelerating the transfer vehicles on said first and second linear sections of said rail structure to a velocity substantially equal to the velocity of the constant-velocity conveyor thereunder, said passive transfer modules being transferred from said first and second constant-velocity conveyor means to said transfer vehicles in the first linear sections of said continuous rail structures, being carried by the transfer vehicles to the loading/unloading platform, being unloaded, being reloaded, then being carried by said transfer vehicles into said linear sections of said continuous rail structures and being transferred from said transfer vehicles onto the oppositely moving, constant-velocity conveyor means.

2. The transportation system of claim 1 wherein the second linear section of each rail structure is divided into an acceleration zone, a transfer zone, and a deceleration zone and wherein said driving means for individually accelerating the transfer vehicles on said second linear section of said rail structure comprises in sequence the combination of, i. in the acceleration zone, means for accelerating the transfer vehicle carrying a transport module to a velocity at most equal to the velocity of the constant-velocity conveyor means thereunder, ii. in the transfer zone, means for accelerating the transfer vehicle carrying said transport module to a velocity of the constant-velocity conveyor means thereunder and said transport module is transferred from said transfer vehicle to the constant-velocity conveyor means thereunder, and iii. in the deceleration zone, means for decelerating, the transfer vehicle to a velocity less than the velocity of the constant-velocity conveyor means thereunder, said constant-velocity conveyor means carrying said transport module away from said transfer vehicle travelling on said continuous rail structure, and wherein the first linear sections of the continuous rail structures are divided into a first acceleration zone, a transfer zone, a second acceleration zone and a deceleration zone, and wherein said driving means for individually accelerating said transfer vehicles travelling on said first linear section of said rail structures comprises in sequence the combination of, i. in the first acceleration zone, means for accelerating the transfer vehicle to a velocity at least equal to the velocity of the constant-velocity means thereunder, said transfer vehicle overtaking a transport module carried on said conveyor means, ii. in the transfer zone, means for decelerating the transfer vehicle to a velocity equal to the velocity of the constant-velocity conveyor means thereunder and said transfer module is transferred from the constant-velocity conveyor means thereunder to the transfer vehicle, iii. in the second acceleration zone, means for accelerating the transfer vehicle carrying the transport module to a velocity greater than the velocity of the constant-velocity conveyor means thereunder, and iv. in the deceleration zone, means for decelerating the transfer vehicle to a velocity less than the velocity of the constant-velocity conveyor means and for bringing the transfer vehicle carrying the transport module to a halt at the loading/unloading platform, whereby said transport module can be first unloaded and then reloaded.

3. The transportation system of claim 2 wherein the first and second constant-velocity conveyor means each have two different elevations with respect to each linear section of each continuous rail structure in the station region.

4. The transportation system of claim 3 wherein the first and second constant-velocity conveyor means each have inclined sections between its respective elevations in the station region.

5. The transportation system of claim 4 further defined in that the first and second constant-velocity conveyor means each have as they enter and exit from the station region in sequence an unloading section, a downwardly-inclined section, a non-transfer section, an upwardly-inclined section, and a loading section.

6. The transportation system of claim 5 wherein the first linear section of each continuous rail structure is disposed in relationship to the constant-velocity conveyor means thereunder such that the first acceleration zone is above a first portion of the unloading section, the transfer zone is above the remainder of the unloading section and a first portion of the downwardly-inclined section, the second acceleration zone is above the remainder of the downwardly-inclined section, and the deceleration zone is above a first portion of the non-transfer section.

7. The transportation system of claim 6 wherein the second linear section of each continuous rail structure is disposed in relationship to the constant-velocity conveyor means thereunder such that the acceleration zone is above the remaining portion of the non-transfer section and a first portion of the upwardly-inclined section, the transfer section is above the remainder of the upwardly-inclined section and a first portion of the loading section, and the deceleration zone is above the remainder of the loading section.

8. The transportation system of claim 7 wherein there is a difference in elevation D between the non-transfer section of each constant-velocity conveyor means and its respective unloading and loading sections, and wherein the transport modules have a heighth H when carried by the conveyor means, and wherein the difference in elevation D is greater than the heighth H of the transport modules on the conveyor means such that the conveyor means can carry transport modules beneath transport modules carried by said transfer vehicles in the nontransfer sections.

9. The transportation system of claim 8 wherein said first and second constant-velocity conveyor means each comprise a continuous belt structure having a plurality of latching shoulders on a top surface wherein each pair of latching shoulders defines a receptacle adapted to receive a transport module, and means for moving said continuous belt structure at a constant velocity.

10. The transportation system of claim 9 wherein each transport module has normally closed latching means adapted to latch onto said latching shoulders on said continuous belt structure for securing the transport modules in the receptacles when said transport modules are carried by said continuous belt structures.

11. The transportation system of claim 10 wherein said transport modules comprise a box-like structure, said normally closed latching means being secured to a bottom side thereof, and an engagement structure extending upward from a top side of said box-like structure.

12. The transportation system of claim 11 wherein said engagement structure extending upwardly from the top side of said transport module includes a longitudinal structural member, oriented in the direction of travel of said transport module on said continuous belt structures, a front bar and a back bar, each secured to said longitudinal structural member and extending perpendicularly with respect to the direction of travel, and a plurality of cylindrical structures, each secured to an extending end of the front and back bars, said cylindrical structures having a greater diametric dimension than said respective front and back bars.

13. The transportation system of claim 12 wherein said transfer vehicle includes a longitudinal tubular housing oriented parallel to the direction of travel of said transfer vehicle on said rail structure, said tubular engagement housing having a top structure and a support platform connected by structural walls, said support platform having a slot oriented parallel to the longitudinal axis of said tubular engagement structure, said slot adapted to receive said longitudinal member of the engagement structure extending from the top said of said transport modules.

14. The transportation system of claim 13 wherein said support platform further defines four receptacles located for receiving the cylindrical structures on the distal ends of said front and back bars of said engagement structure on the top side of said transport module when said transfer vehicle carries said transport module.

15. The transportation system of claim 14 further defined in that said cylindrical structures on the distal end of the front bar of the engagement structure on the top side of said transport modules include in co-axial alignment a central cylindrical conductive sleeve sandwiched between two cylindrical shoulders composed of an insulative material, said cylindrical shoulders having greater diametric dimension than said conductive cylindrical sleeve, and wherein said receptacles in said support platform receiving said cylindrical structures on the distal end of said front bar includes means for making electrical connection with said conductive cylindrical sleeve of said cylindrical structures.

16. The transportation system of claim 15 wherein said normally closed, latching means secured to the bottom side of said transport modules include an electrical energizing means for opening said latching means, said electrical energizing means being electrically connected to said conductive sleeves of the cylindrical structures on the distal ends of said front bar of the engagement structure extending from the top side of said transport module, whereby said electrical energizing opens said latching means to release the transport module from said continuous belt structure when an electrical connection is established between the conductive sleeves of the cylindrical structures on the distal end of the front bar of the transport module engagement structure and the electrical contact means within the receptacle of the support platform in the tubular engagement housing of the transfer vehicle.

17. The transportation system of claim 16 wherein said driver means for accelerating and decelerating the transfer vehicles in the respective zones on the continuous rail structures comprises in combination, a first continuous conductor mounted on said continuous rail structure, a second conductor mounted on said continuous rail structure divided into a plurality of conductive segments, each segment corresponding to a particular zone on said continuous rail structures, means for electrically insulating each conductive segment of said second conductor from the remaining conductive segments thereof, a first and second contact means in each transfer vehicle for maintaining electrical connection with said first conductor and said second conductor respectively as said transfer vehicle travels on the rail structure;

an electrical driver means mounted in each transfer vehicle electrically connected to said first and second contact means, an electrical current source having a first terminal connected to said first continuous conductor and having a second terminal, said electrical current source being adapted to conduct an electrical current between its first terminal and second terminal when electrical connection is established therebetween, a control means having an input electrically connected to said second terminal of the electrical current source and a plurality of outputs, each electrically connected to one of said conductive segments of said second conductor for controlling electrical current supply between the first conductor and the respective conductive segments of the second conductor when an electrical connection is established between the first conductor and the respective conductive segment of the second conductors, whereby said first and second contact means on said transfer vehicles establish electrical connection between said first conductor and each conductive segment of said second conductor to thereby supply electrical current to said electrical driver means.

18. The transportation system of claim 17 wherein the electrical current source supplies direct electrical current and wherein said electrical driver means comprises in combination a driver wheel mounted in said transfer vehicle adapted to engage said rail structure and adapted to rotate, a direct current electrical motor mounted in said transfer vehicle mechanically coupled to said driver wheel for rotatably driving said driver wheel whereby the acceleration, deceleration and velocity of said transfer vehicles in a particular zone is determined by the electrical current supplied to the first conductor and the particular conductive segment of the second conductor for that zone.

19. The transportation system of claim 18 wherein said first and second conductors on said rail structure comprise first and second rails respectively, secured on opposite surfaces of said rail structure, said driver wheel of said transfer vehicle engaging the first rail, and wherein said second contact means comprises a trolley pulley insulatively mounted on the top structure of said tubular engagement housing of said transfer vehicle, said trolley pulley engaging and maintaining an electrical connection with said second rail.

20. The transportation system of claim 19 wherein said normally closed latching means comprises in combination, a front and a back latching structure pivotally secured to a front end and a back end respectively of the bottom side of said transport module, each latching structure being adapted to receive and engage a latching shoulder on said continuous belt structure, a lever member having a central pivot point and two extending arms secured to the bottom side of said transport module adapted to pivot in a plane parallel to said bottom side, a first and a second rod, said first rod mechanically coupling one arm of said lever member to said front latching structure, said second rod mechanically coupling the remaining arm of said lever member and said back latching structure, a biasing spring engaging one arm of said lever member for biasing said front and back latching structures in a closed position, and a push-rod mechanism for rotating said lever member compressing said biasing spring whereby said front and back latching structures are pivoted outwardly into an open position releasing said latching shoulders on said continuous belt structure.

21. The transportation system of claim 20 wherein said push-rod mechanism includes an extending member having an inserted position and an extended position, a spring connected between an end of said extending member and one arm of said lever member and a lateral support structure integral with the bottom side of said transport module for providing lateral support to said extending member as it moves from its inserted position to its extended position, said spring being in tension when said extending member is in the inserted position and said spring being in compression when said extending member is in said extended position, whereby said spring holds the latching structures in a normally closed position when said extending member of the push-rod mechanism is in the inserted position and whereby said spring rotates said lever member when said extending member is in the extended position pivoting said front and back latching structures outwardly.

22. The transportation system of claim 21 wherein said push-rod mechanism is electrically energized.

23. The transportation system of claim 2 further defined in that said continuous rail structures of said first and second transfer means each have a plurality of sections connecting the first and second linear sections at the respective ends of said linear sections.

24. The transportation system of claim 8 wherein said driving means for accelerating and decelerating the transfer vehicles in the respective zones comprise in combination, electrical driver means mounted in each transfer vehicle, and separate means in each of said respective zones for electrically energizing said electrical driver means.

25. The transportation system of claim 10 further including a detection means located adjacent each incoming, constant-velocity continuous belt structure in the station region for determining the presence of and spacing of transport modules on the respective continuous belt structures.

26. The transportation system of claim 25 wherein each detection means comprises in combination, a first detection station located adjacent the downwardly-inclined section of the constant-velocity continuous belt structure having means for generating an electrical signal responsive to a transport module being carried by said continuous belt structure by said first detection station, a second detection station located adjacent the constant-velocity continuous belt structure at the end of its unloading section, having means for generating an electrical signal responsive to a transport module being carried by said continiuous belt structure by said second station, a third detection station located adjacent the incoming constant-velocity continuous belt structure, a distance (d) upstream from said first detection station, said third detection station having means for generating an electrical signal responsive to a transport module being carried by said continuous belt structure by said third detection station, and said distance (d) between said first and third detection stations is equal to a required spacing distance between transport modules being carried by said constant-velocity continuous belt structure, and an electronic signal processing means receiving said electrical signals generated by said first, second and third detection stations for controlling transfer vehicles carrying transport modules for placement on the constant-velocity continuous belt structure as it exits from the station region.

* * * * *